United States Patent [19]

McKinley

[11] Patent Number: 5,042,687

[45] Date of Patent: Aug. 27, 1991

[54] SHOPPING BAG DISPENSER

[75] Inventor: Thomas McKinley, Toronto, Canada

[73] Assignee: The Bag Saver International Inc., Ontario, Canada

[21] Appl. No.: 218,134

[22] Filed: Jul. 13, 1988

[30] Foreign Application Priority Data

Apr. 13, 1988 [CA] Canada ..... 564081

[51] Int. Cl.[5] ..... A47F 1/04

[52] U.S. Cl. ..... 221/311; 221/45; 221/61; 221/155

[58] Field of Search ..... 221/33, 45, 61, 155, 221/134, 311, 312

[56] References Cited

U.S. PATENT DOCUMENTS

| | | | |
|---|---|---|---|
| 3,210,140 | 10/1965 | Smythe | 221/311 |
| 3,724,716 | 4/1973 | Baraconi et al. | 221/61 |
| 4,574,981 | 3/1986 | Jewett | 221/311 |
| 4,623,073 | 11/1986 | Hansen | 221/45 |

FOREIGN PATENT DOCUMENTS

| | | | |
|---|---|---|---|
| 520192 | 1/1956 | Canada | 221/311 |
| 2203292 | 8/1973 | Fed. Rep. of Germany | 221/45 |

*Primary Examiner*—A. Michael Chambers

[57] ABSTRACT

Plastic shopping bag container to store randomly disposed shopping bags with lower horizontal slot for removal of stored bag.

7 Claims, 3 Drawing Sheets

SHOPPING BAG DISPENSER

This invention relates to a plastic shopping bag container and dispenser.

Today there is found around a dwelling a large number of plastic shopping bags. These are of the type which are often associated with supermarkets although similar bags are now used by many stores.

As such bags are brought home and emptied of their merchandise a thrifty homeowner wishes to save them for re-use. Customarily these are kept in a loose box or pile but such arrangements have rendered the empty bags somewhat inconvenient to store and retrieve, and the stored supply is frequently untidy.

This invention therefore provides a bag container and dispenser for plastic shopping bags comprising a vertically extending container, having a bottom wall and side walls, designed to allow the insertion of plastic shopping bags in the top in random array; and a horizontal slot in the side wall of the container of large enough dimension to allow digital extraction of bags therethrough.

There is then provided a convenient container for these empty bags and into which they may be placed in a random pile for convenient extraction through the bottom slot as required. The container may be attractively decorated or styled.

Preferably the container is provided with a vertical slot which may be used to allow digital moving of the bags toward the lower slot. In the preferred arrangement the vertical slot is located over the horizontal slot, for convenience of use.

Preferably the container walls are provided on the inside with downwardly and inwardly sloping dogs which allow downward movement of the bags therepast but catch on the bags to prevent them expanding upwardly or moving back upwardly therepast. The dogs therefore tend to provide a 'ratchet' effect which allows bags to be compressed downwardly therepast and tends to prevent them moving back upwardly.

In drawings which illustrate a preferred embodiment of invention:

Figure 1:
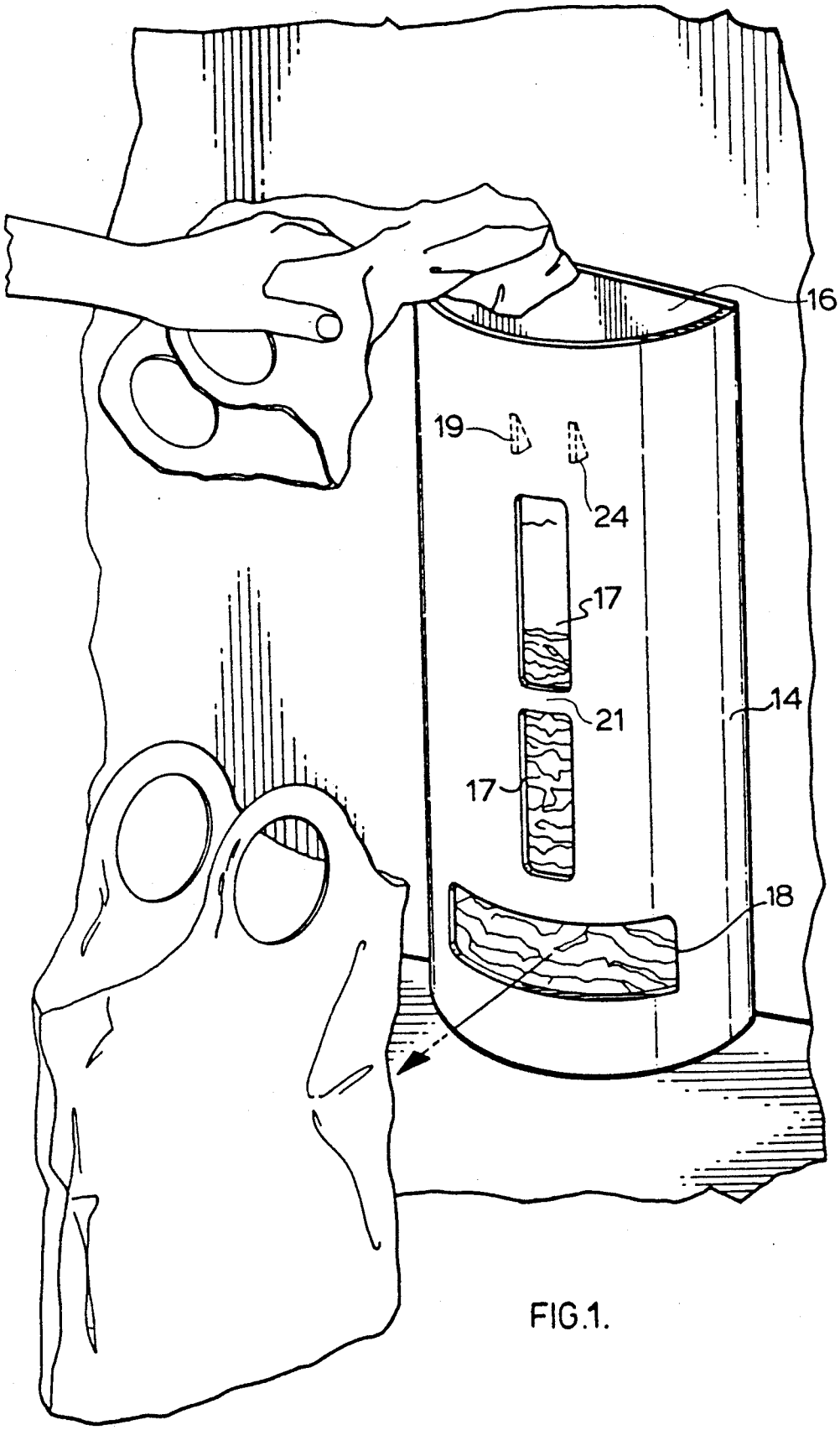
FIG. 1 is a perspective view of the invention.
Figure 2:
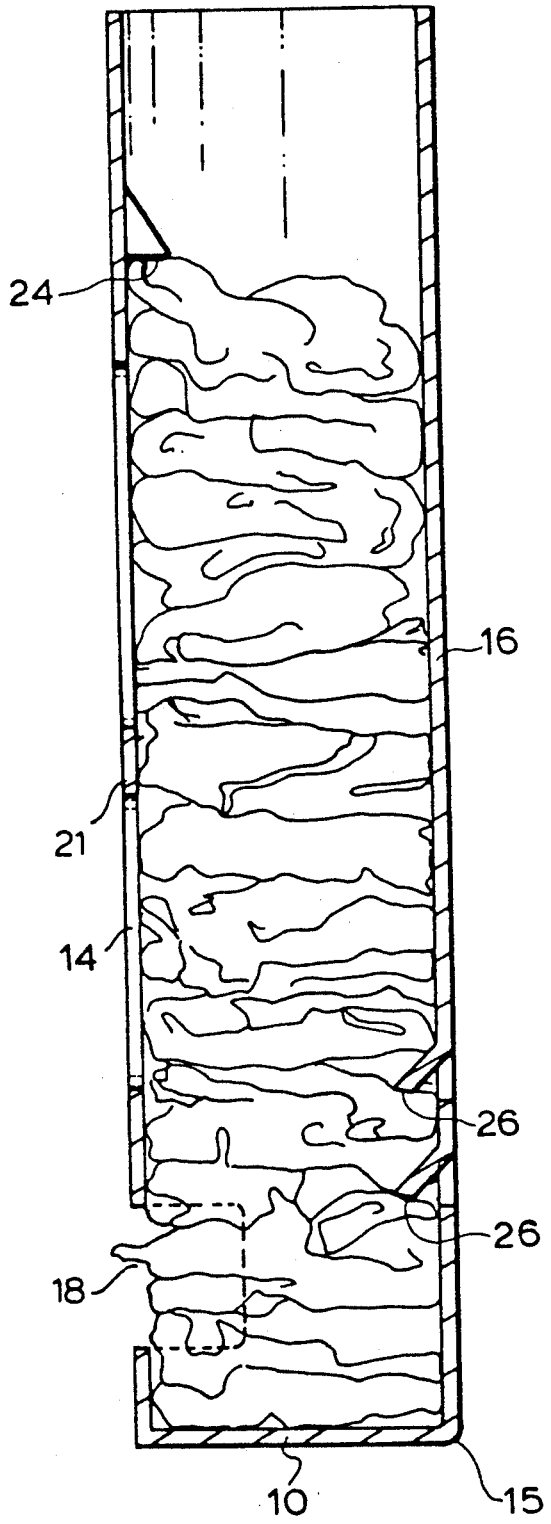
FIG. 2 is a vertical section therethrough.
Figure 4:
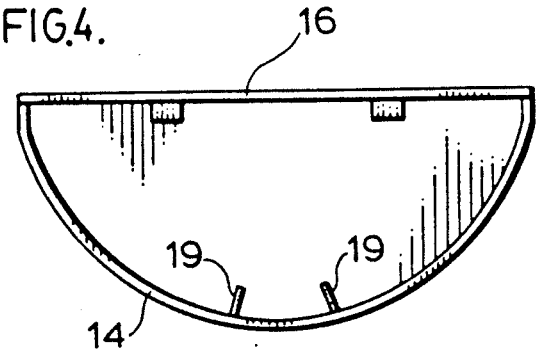
FIG. 4 is a top view.
Figure 3:
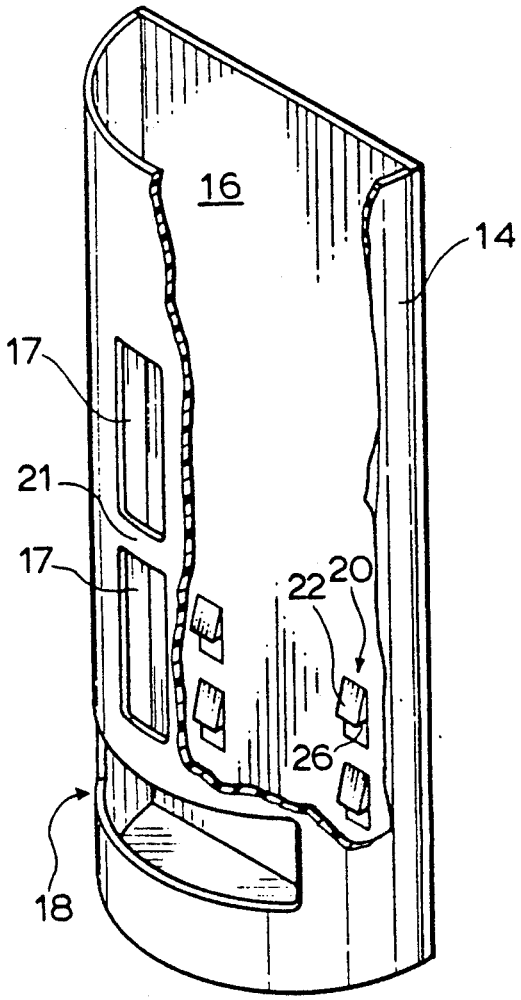
FIG. 3 is a cut-away perspective of the device.

In the drawings, a vertically extending container is provided with a bottom 10 curved side wall 14 and flat side wall 16. The open topped container may if or when desired be covered by a cover not shown.

The container is preferably semi-circular in horizontal section, as shown, with its curved side slotted as hereinafter described.

The container with its curved and flat side walls 14 and 16 and bottom 10 may be made in any of a number of conventional ways well known to those skilled in the art. It is preferred to mold the flat side wall 16 and semi-circular bottom 10 as one member, with a 'line' hinge 15 between; and the curved side wall 14 as the other and attach these in any of a number of conventional manners.

In the side walls just above the bottom 12 is a horizontal slot 18 of sufficient width and length dimensions to allow digital extraction of a bag from the container. If for any reason two bags are extracted when one is wanted the extra bag may merely be returned to the top.

Above the horizontal slot are the vertical slots 17 of sufficient width and depth to allow digital manipulation of the bags in the container down to an accessible position for the lower slot. Slots 17 are separated by a bridge 21 integral with the wall 14 for strength.

Preferably the walls of the container are provided with means to provide a 'ratchet' effect which allows bags to be pushed down or compressed in the container and tends to prevent them moving back upwardly. In the preferred embodiment the means are embodied by dogs 19 located on the inside of curved wall 14 having inner edges sloping downwardly and inwardly and a horizontal bottom edge 24. Also in the preferred embodiment dogs 20 located on the inner flat walls 16 have inner surfaces 22 sloping downwardly and inwardly and horizontal bottom edges 26.

In operation therefore the container is filled with empty shopping bags in random orientation. If there are not enough bags these are arranged to be accessible through slot 18 by the use of slots 17. The bags are extracted as described.

When the bags are pressed downwardly past dogs 19 or 20 any tendency for them to return or expand upwardly is resisted by the bottom dog edges 24 or 26, having the effect of maintaining the bags in compressed array and maintaining a pressure on them downwardly toward slot 18.

The container may be of any material but is preferably of molded plastic with an optional separate lid not shown.

I claim:

1. Plastic shopping bag container and dispenser comprising a vertically extending container, having a bottom wall and side walls, designed to allow the insertion of plastic shopping bags at the top thereof in random array, and a horizontal slot in the side wall of the container of large enough dimension to allow digital extraction of bags therethrough, combined with means having a ratchet effect which allows downward movement of the bags therepast and tends to prevent them moving back upwardly.

2. Plastic shopping bag container and dispenser comprising a vertically extending container, having a bottom wall and side walls, designed to allow the insertion of plastic shopping bags at the top thereof in random array, and a horizontal slot in the side wall of the container of large enough dimension to allow digital extraction of bags therethrough, wherein said container is substantially semi-circular in horizontal section to have a curved side wall containing said horizontal slot.

3. Plastic shopping bag container and dispenser as claimed in claim 2 wherein a vertical slot is located in a side wall of said container, said slot allowing digital movement of bags in said container downward toward said horizontal slot.

4. Plastic shopping bag container and dispenser as claimed in claim 18 wherein said vertical slot is located over said horizontal slot.

5. Plastic shopping bag container and dispenser comprising a vertically extending container, having a bottom wall and side walls, designed to allow the insertion of plastic shopping bags at the top thereof in random array, and a horizontal slot in the side wall of the container of large enough dimension to allow digital extraction of bags therethrough, wherein said container is substantially semi-circular in plan view, having a curved and a straight side wall, and a substantially semi-circular bottom wall said curved side wall having the horizontal slot, wherein said flat side wall and said bottom wall are a single member.

6. Plastic shopping bag container and dispenser as claimed in claim 5 wherein a vertical slot is located in a side wall of said container, said slot allowing digital movement of bags in said container downward toward said horizontal slot.

7. Plastic shopping bag container and dispenser as claimed in claim 6 wherein said vertical slot is located over said horizontal slot.

* * * * *